United States Patent [19]

Blouin

[11] 4,429,930

[45] Feb. 7, 1984

[54] INTERLOCK FOR DRAWERS

[75] Inventor: Joseph L. D. C. Blouin, Levis, Canada

[73] Assignee: Nightingale Saro Inc., Romuald, Canada

[21] Appl. No.: 356,808

[22] Filed: Mar. 10, 1982

[30] Foreign Application Priority Data

Dec. 24, 1981 [CA] Canada ..... 393236

[51] Int. Cl.[3] ..... E05B 65/46; E05C 15/04

[52] U.S. Cl. ..... 312/216; 312/221; 312/222; 312/107.5

[58] Field of Search ..... 312/215, 216, 217, 218, 312/219, 220, 221, 222, 107.5

[56] References Cited

U.S. PATENT DOCUMENTS

| | | | |
|---|---|---|---|
| 1,139,940 | 5/1915 | Westmoreland | 312/221 |
| 1,280,183 | 10/1918 | Donathan | 312/221 |
| 3,404,929 | 10/1968 | Wright et al. | 312/216 |
| 3,791,708 | 2/1974 | Signore | 312/221 |
| 3,874,755 | 4/1975 | Hegg et al. | 312/222 |
| 3,969,008 | 7/1976 | Pergler | 312/218 |
| 4,268,076 | 5/1981 | Itoi | 312/222 |
| 4,298,236 | 11/1981 | Laroche | 312/215 |
| 4,303,287 | 12/1981 | Taplin | 312/217 |
| 4,355,851 | 10/1982 | Slusser | 312/215 |

FOREIGN PATENT DOCUMENTS

| | | | |
|---|---|---|---|
| 1175151 | 12/1969 | United Kingdom | 312/222 |

*Primary Examiner*—Victor N. Sakran

*Attorney, Agent, or Firm*—George A. Rolston

[57] ABSTRACT

A drawer interlock apparatus for multiple drawers having at least one drawer locking cam for each drawer, which is pivotally movable between open and closed positions, a drawer pin on each drawer interengageable with the cam, when in the closed position, and being releaseable from the cam in the open position to permit the drawer to be opened, linkage connecting the cam with the next adjacent cam of a next adjacent drawer, such linkage being responsive to opening movement of said first mentioned cam, to prevent opening movement of the second mentioned cam.

7 Claims, 4 Drawing Figures

INTERLOCK FOR DRAWERS

The invention relates to a drawer interlock systems for use in chests, cabinets and the like, and is of particular interest for use in association with filing cabinet drawers.

Drawer interlock systems are used in multiple drawer chests and cabinets, in order to ensure that only one drawer can be opened at a time. In some cases, the opening of two or more drawers simultaneously can cause the cabinet to tip over, and where the cabinet is large or the contents of the drawers are substantial, injury or damage can result.

A variety of drawer interlock systems have been proposed in the past but have suffered from various defects. Particularly, such interlock systems in some cases have been unnecessarily complex. Over years of use, such complex systems, which originally may have worked satisfactorily, become clogged with dried out greases, dust and debris, such that they no longer function. Simpler systems have been proposed, using less complex mechanism, but in the majority of cases they have not been completely satisfactory and have not always functioned in the manner intended. In some cases, it is possible to pull out two drawers at the same time and defeat the interlock system altogether. In other cases, for example, if one drawer is slightly open, then the opening of another drawer will cause the entire system to jam.

For all of these reasons therefore there is clearly a need for an improved form of drawer interlock system which is of simple, rugged construction such that it will function effectively for many years, and which will operate in a safe manner so that two or more drawers cannot be withdrawn at once.

BRIEF SUMMARY OF THE INVENTION

With a view to providing these objectives, the invention comprises a drawer interlock apparatus for multiple drawers comprising at least one drawer locking cam for each drawer, which is pivotally movable between open and closed positions, drawer pin means on each said drawer interengageable with such cam, when in the closed position, and being releaseable from such cam in the open position to permit the drawer to be opened, linkage means connecting said cam with the next adjacent cam of a next adjacent drawer, such linkage means being responsive to opening movement of said first mentioned cam, to prevent opening movement of the second mentioned cam.

The invention further comprises the provision of guide means for guiding said linkage means for sliding movement relative to said drawers, and the provision of rotary connection means in said linkage means, whereby to permit transmission of a semi-rotary movement of said cam to said linkage means.

The invention further comprises the provision of pivotal mounting means for said cam, said pivotal mounting means being in turn mounted on a portion of said linkage means, whereby the pivot axis of said cam is moved by movement of said linkage means caused by movement of a next adjacent drawer.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figures 1, 2:
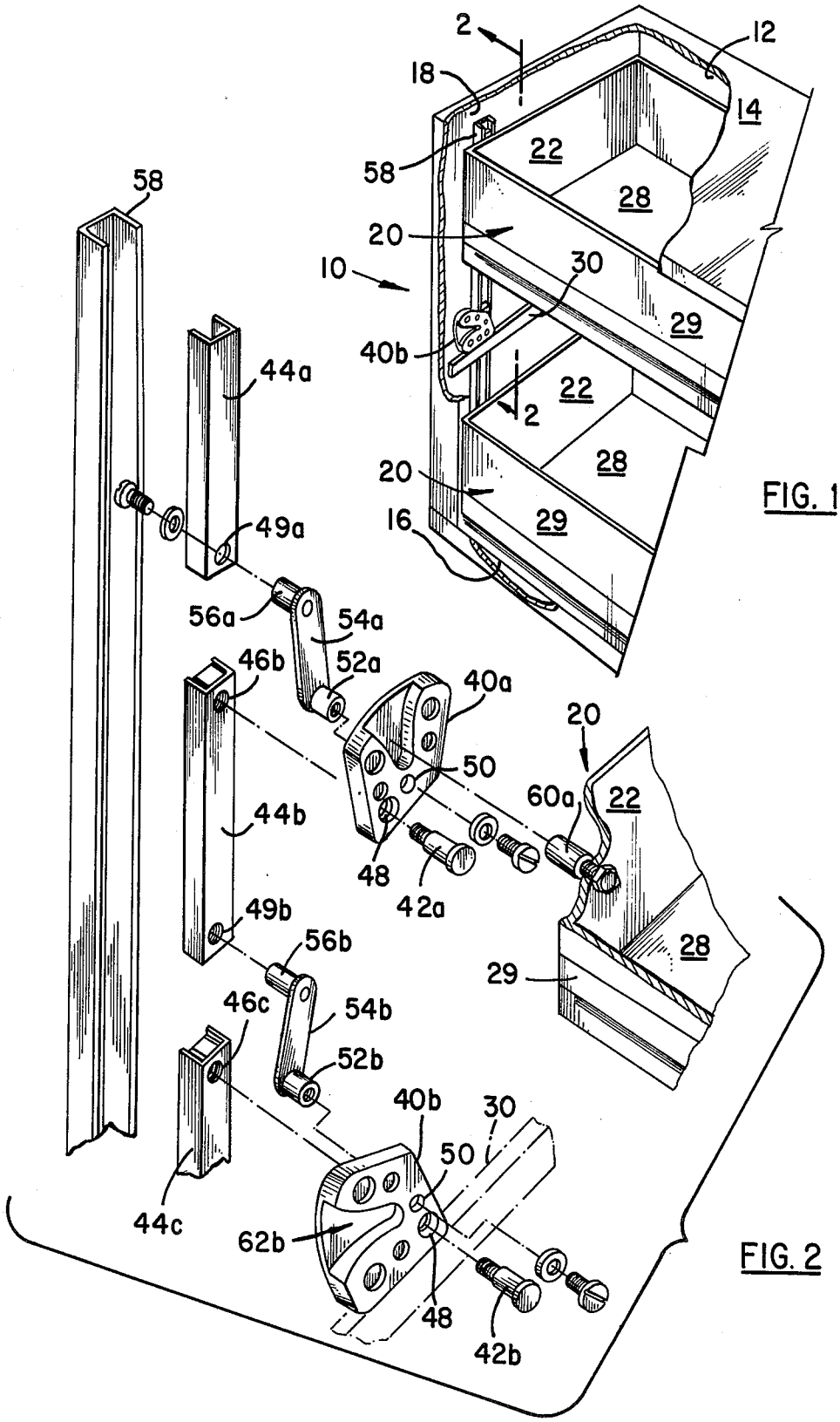
FIG. 1 is a perspective illustration partially cut away, showing a typical cabinet, and a single drawer therein, and the interlock mechanism according to the invention.
FIG. 2 is an exploded perspective illustration of the interlock mechanism shown in isolation in one position.

Referring now to FIG. 1, it will be seen that the cabinet according to the invention is shown generally as 10, and in this case represents a typical filing cabinet which may be of the lateral-drawer or vertical type. Such a cabinet 10 has a back wall 12, a top wall 14 and a bottom wall 16, and side walls 18.

Typically, filing cabinets come with a plurality of drawers in a variety of numbers, depending upon the requirements of the user. One such drawer is shown generally as 20, and will be seen to comprise side panels 22, a back panel 24, a bottom panel 28 and a front panel 29.

Typically, in the case of file drawers, for example, such drawers are mounted on telescopic extendable slides indicated as 30, the details of which are omitted for the sake of clarity and which are in any event well known in the art.

As is a common experience, such file drawers, when fully loaded with files and papers, become extremely heavy. Usually the design of such cabinets is such that when only one drawer is withdrawn, and provided the other drawers are equally filled, then the cabinet will remain upright. The center of balance will clearly change, due to the opening of one drawer, but it will not change to such an extent that the cabinet will tip over.

However, it is possible that two or more drawers may be withdrawn simultaneously. Alternatively, in some cases one drawer will already be open, and an office worker will then simply pull open a second drawer without closing the first drawer. In these circumstances the center of balance will move so far that the cabinet will overbalance.

In order to avoid this situation, drawer interlocks are provided such that when one drawer has been opened, the remaining drawers are locked shut. This then forces persons to close a drawer, before any others can be opened.

In some cases, it is possible to combine such a drawer interlock system with a key lock system for actually locking the filing drawers as a security measure when the office is unoccupied.

It will of course be appreciated that the drawer interlock system according to the invention can be provided with such a key lock system if desired, in a manner well known in the art, the details of which are omitted for the sake of clarity.

The drawer interlock system according to the invention is shown in more detail in FIG. 2. It will be seen to comprise a plurality of drawer interlock cams, each of which is shown as 40, and which may be provided either one cam to each drawer, or two such cams, one on either side of each drawer if desired for greater security. In this case it will of course be appreciated that the mechanism which is shown in FIG. 2 would be provided on the right and left hand side walls of the cabinet 10. For the purposes of this discussion, however, only one such mechanism will be described, it being understood that the description would be equally applicable to the interlock mechanism on the other end of the cabinet, if such was provided.

Corresponding parts on each drawer interlock mechanism are indicated as a-b-c, etc.

The cam 40*a* is pivotally mounted on a pivot pin 42*a*, which is fastened by one end to a slide bar 44*b* at opening 46*b*. Pivot pin 42*a* passes through pivot hole 48 in cam 40*a*, pivot hole 48 being located to one side of cam 40*a*, for reasons to be described below.

A further opening 50, in cam 40*a*, spaced laterally from opening 48, provides a point of pivotal attachment to pivot pin 52*a*. Pin 52*a* is located at one end of crank arm 54*a*. The upper end of crank 54*a* is provided with a further pivot pin 56*a*. Pivot pin 56*a* is connected to slide bar 44*a*, at pivot opening 49*a*. A similar opening 49*b* is provided at the lower end of slide bar 44*b*.

Slide bars 44*a, b, c,* and *d* are slidably received in vertical channel 58, and are slidable in a vertical manner. Drawer securing means such as locking pins 60*a-b-c* are provided on the respective drawers 20*a-b-c*, and are slidably received in slots 62*a-b-c* of respective cams 40*a-b-c*.

Typically, cams 40 will be formed of suitable quality injection molded plastics material. For this purpose, they will preferably be provided with suitable openings or recesses, for the purpose of reducing the quantity of plastic.

Figure 3:
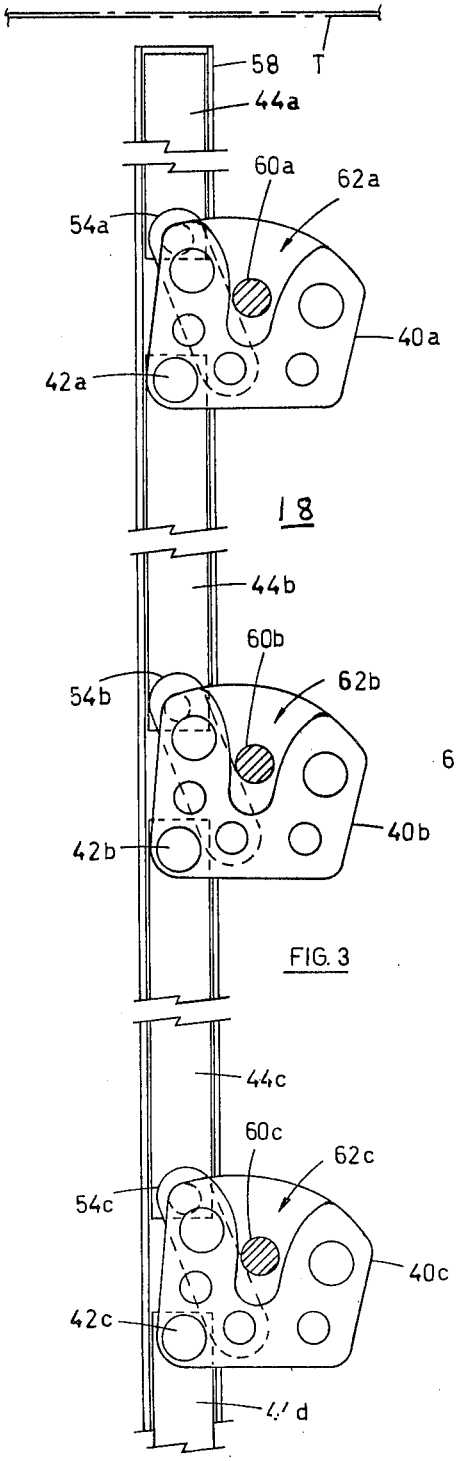
FIG. 3 is a schematic side elevation showing the interlock mechanism in the position corresponding to FIG. 2, and, FIG. 4 is a similar schematic illustration showing interlock position in another position.

In operation, when all of the drawers 20 are closed, the cams 40*a-b-c* will be located tilted upwardly, essentially as shown in FIG. 3. In this position, the respective drawer locking pins 60 are located in the slots 62. In this position the cams are all essentially in a "neutral" mode. Any one drawer can be opened at will.

When any one drawer, e.g. drawer 20*b*, is pulled open, as it moves forwardly, the drawer locking pin 60*b* will pull the corresponding cam 40*b* forwardly. Cam 40*b* will thus pivot about pivot pin 42*b*, and rotate into a position wherein the slot 62*b* is aligned essentially horizontally.

Drawer locking pin 60*b* is then free to move out of slot 62*b*, and the drawer can be fully opened without restriction.

Figure 4:
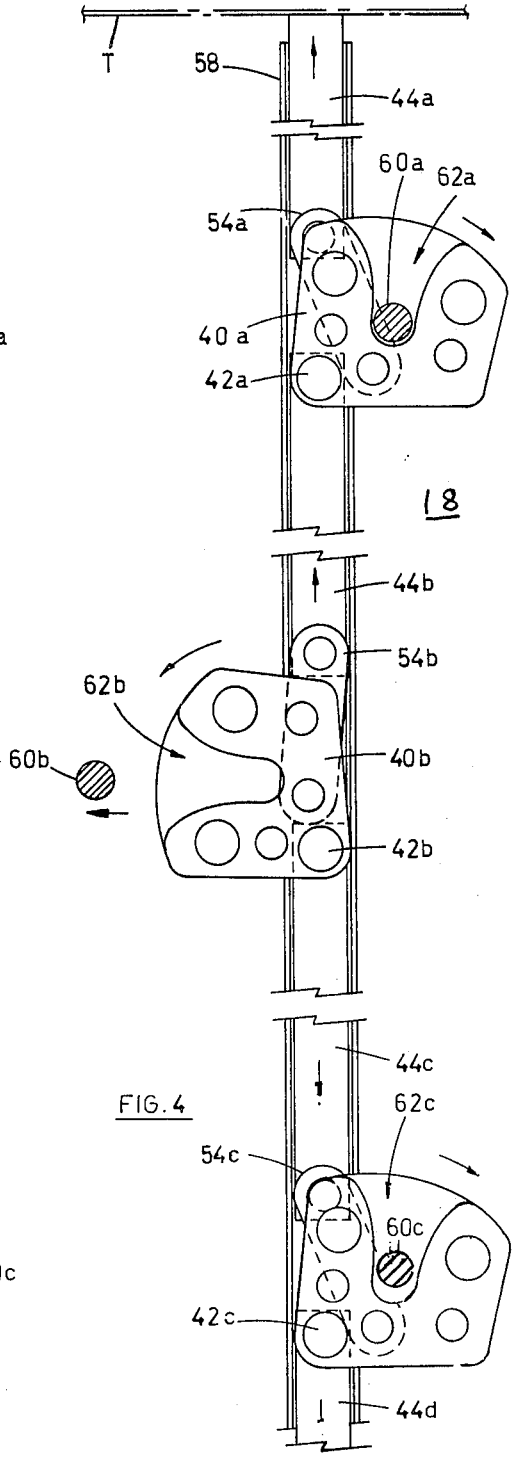

Movement of cam 40*b* into the open position will cause slide bar 44*b* to rise upwardly in channel 58, arm 54*b* swinging forwardly through the vertical, into a position (FIG. 4) in which it is angled a few degrees past the vertical.

Movement of bar 44*b* will also force cam 40*a* upwardly, causing pin 60*a* to seat in the bottom of slot 62*a*. Slide bar 44*a* will thus also be forced upwardly, until it meets a suitable stop (not shown). Cam 40*a* is thus no longer "neutral" but is locked against opening, since its slide bar 44*a* cannot move upwardly.

The forward swinging of arm 54*b* creates an "overcenter" position. Cam 40*b* (FIG. 1) rests on the drawer slide 30, and thus cannot swing downwardly.

Cam 40*b* is thus held locked in its open position, so long as its drawer 20*b* remains open.

Slide bar 44*c* and cam 40*c* are also held closed, since slide bar 44*c* is unable to rise upwardly, so long as cam 40*b* is open.

Thus, both of the other cams 40*a* and 40*c* are held locked in their closed position.

When the drawer 20*b* which has been opened, is then pushed shut again, its pin 60*b* will move back into the slot 62*b*, and cause the cam 40*b* to rotate back into its closed position. This will then procure reverse swinging of arm 54*b*, freeing slide bars 44*b* and 44*a* and cam 60*a*. Such movement will also free slide bar 44*c* and cam 40*c*.

In this position, one of the other drawers may then be opened if desired, without restriction, since any one of the cams can then be operated simply by pulling one drawer outwardly.

It will thus be seen that the drawer interlock according to the invention permits one drawer at a time to be opened, while simultaneously locking the other two against opening.

However, once all three drawers have been closed, then any one drawer can readily be opened at will.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A drawer interlock apparatus for a cabinet having multiple drawers comprising;

a plurality of slide bars mounted within such cabinet and movable between locking and releasing positions;

at least one drawer locking cam for each drawer, each such cam being pivotally mounted on a first pivot axis on a respective slide bar, and being movable between open and closed positions;

a recess in such locking cam;

drawer securing means on each said drawer interengageable with such recess in such cam, when in the closed position and being releasable from such recess in the open position to permit the drawer to be opened, and, linkage means connected to said cam at a second pivot axis spaced from said first pivot axis, and said linkage means connecting to the slide bar of the next adjacent cam of a next adjacent drawer, such linkage means being responsive to opening movement of said first mentioned cam about said first pivot axis into its open position to move the slide bar to which such linkage is connected and thereby move the next adjacent cam to which such slide bar is connected and thereby prevent opening movement of the second mentioned cam.

2. A drawer interlock apparatus as claimed in claim 1 wherein said drawer locking cam is movable between a closed position in which said recess is directed upwardly, and an open position in which said recess is directed generally horizontally, and wherein said drawer securing means is movable into and out of said recess along an essentially horizontal path.

3. A drawer interlock apparatus as claimed in claim 2 wherein movement of said drawer from a closed to an open position causes said drawer securing means to rotate said cam from said closed to open position, and said drawer securing means thereafter moving outwardly from said recess, and wherein movement of said drawer from said open to said closed position, moves said drawer securing means into said recess, with said cam rotating from said open to said closed position.

4. A drawer interlock apparatus as claimed in claim 1 including guide means slidably retaining said slide bars for sliding movement along a predetermined generally vertical path.

5. A multi-drawer cabinet, each said drawer being movable relative to said cabinet between open and closed positions, said cabinet and said drawers, when in their closed position, having a predetermined center of gravity, and wherein movement of two or more said drawers from their closed to their open position displaces said center of gravity beyond the balance point, said cabinet comprising;

a generally rectangular housing having side walls, top wall and a bottom;

a plurality of movable drawer members located vertically above one another in said cabinet, slidable support means on which said drawer members may be moved between open and closed positions relative to said cabinet;

a plurality of slide bars mounted within such cabinet and movable between locking and releasing positions;

at least one drawer locking cam for each said drawer, each such cam being pivotally mounted on a first pivot axis on a respective slide bar, and being movable between open and closed positions;

drawer securing means on each said drawer interengageable with such cam, when in the closed position, and being releaseable from such cam when in the open position to permit the drawer to be open, and linkage means connected to said cam at a second pivot axis spaced from said first pivot axis, and said linkage means connecting to the slide bar of the next adjacent cam of a next adjacent drawer, whereby movement of one said cam from its said closed to its open position about said first pivot axis into its open position to move the slide bar to which such linkage is connected and thereby move the next adjacent cam to which such slide bar is connected, is communicated and effectively lock the same against movement into the open position, thereby locking all other drawers in said cabinet.

6. A drawer interlock as claimed in claim 1 including stop means for engaging such cam in its open position.

7. A drawer interlock as claimed in claim 4 wherein said linkage is swingable between a rearward position angled rearwardly from such mounting bar, and a forward position angled forwardly of such mounting bar thereby creating an over-center position for locking its associated cam in its open position.

* * * * *